US006119623A

United States Patent [19]

Penland et al.

[11] Patent Number: 6,119,623

[45] Date of Patent: Sep. 19, 2000

[54] GOLF SCORE KEEPING DEVICE

[76] Inventors: Richard W. Penland, P.O. Box 1711, Sandpoint, Id. 83864; Jeffrey L Bendio, 13903 E. Sprague Ave., Suite 8, Spokane, Wash. 99216

[21] Appl. No.: 09/233,220

[22] Filed: Jan. 19, 1999

[51] Int. Cl.[7] ..... A63F 1/18; A63F 11/00; G09F 9/00

[52] U.S. Cl. ..... 116/222; 116/225; 273/DIG. 26

[58] Field of Search ..... 116/222, 225, 116/224, 307, 308, 321, 322, 323, 324; 273/DIG. 26; 473/283

[56] References Cited

U.S. PATENT DOCUMENTS

| | | | |
|---|---|---|---|
| 1,468,143 | 9/1923 | Eldridge | 235/123 |
| 2,704,048 | 3/1955 | Perier | 116/224 |
| 2,813,504 | 11/1957 | Johnson | 116/324 |
| 2,866,433 | 12/1958 | Kallick et al. | 116/324 |
| 3,480,276 | 11/1969 | Torresen | 473/67 |
| 3,485,204 | 12/1969 | Christman | 116/324 |
| 3,584,597 | 6/1971 | Simmons | 116/225 |
| 4,208,984 | 6/1980 | Glanzman | 116/307 |
| 4,212,261 | 7/1980 | Gaetano | 116/224 |
| 4,584,961 | 4/1986 | Zimmer | 116/223 |
| 4,860,684 | 8/1989 | Al-Harbi | 116/308 |
| 5,048,452 | 9/1991 | Haddock et al. | 116/225 |

*Primary Examiner*—Andrew H. Hirshfeld
*Assistant Examiner*—R. Alexander Smith
*Attorney, Agent, or Firm*—David S. Thompson

[57] ABSTRACT

A golf score keeping device is formed from a body 50 having interlocking front and back portions 100, 200. A preferred version of the front portion includes five slides, each slide defining a slide trough within which at least one slide indicator may travel. A similar back portion includes six slides having a total of four slide troughs. A slide channel between the slides of each body portion provides spaced teeth which are engaged by an arm extending from the slide indicator, thereby providing a distinct click as the slide indicator is moved a discrete distance. Slide indicators traveling in the slide trough of one portion 100, 200, extend through the slide channel of the other portion 200, 100. Left and right end covers 300, 400 secure the front and back portions, and protect the slide indicators from contact with a flat supporting surface.

3 Claims, 4 Drawing Sheets

FIG. 3
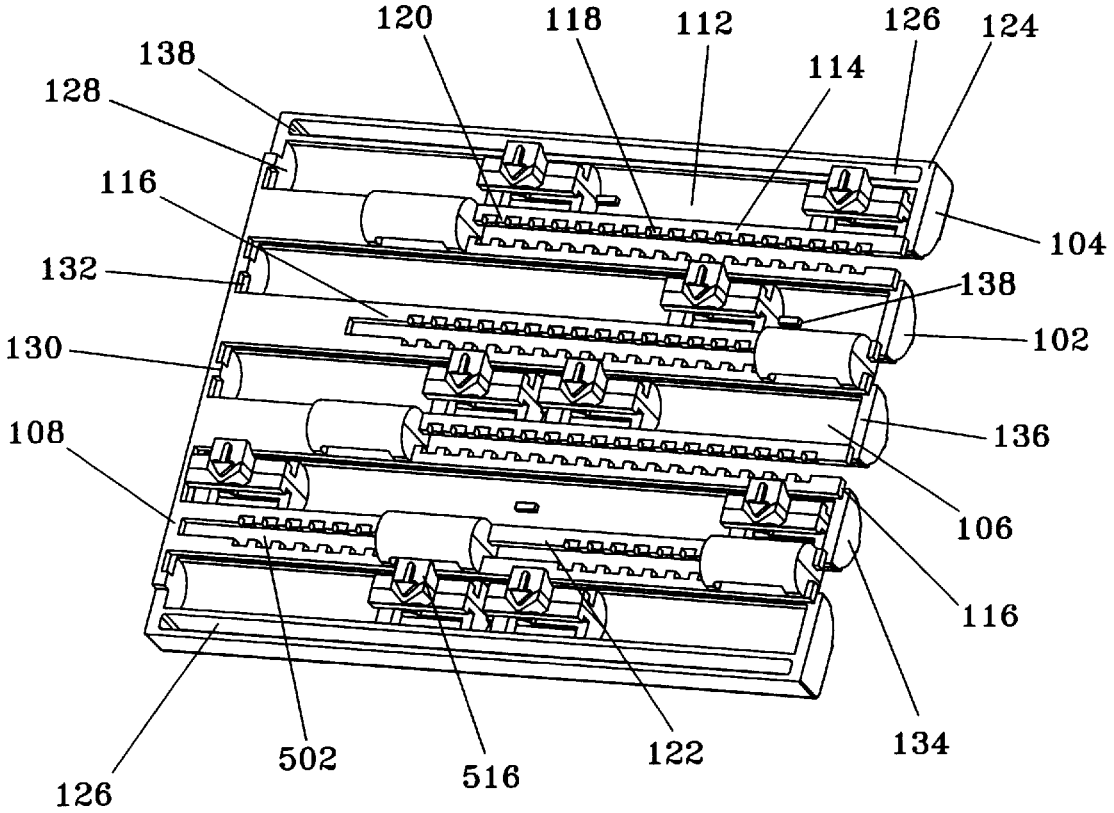
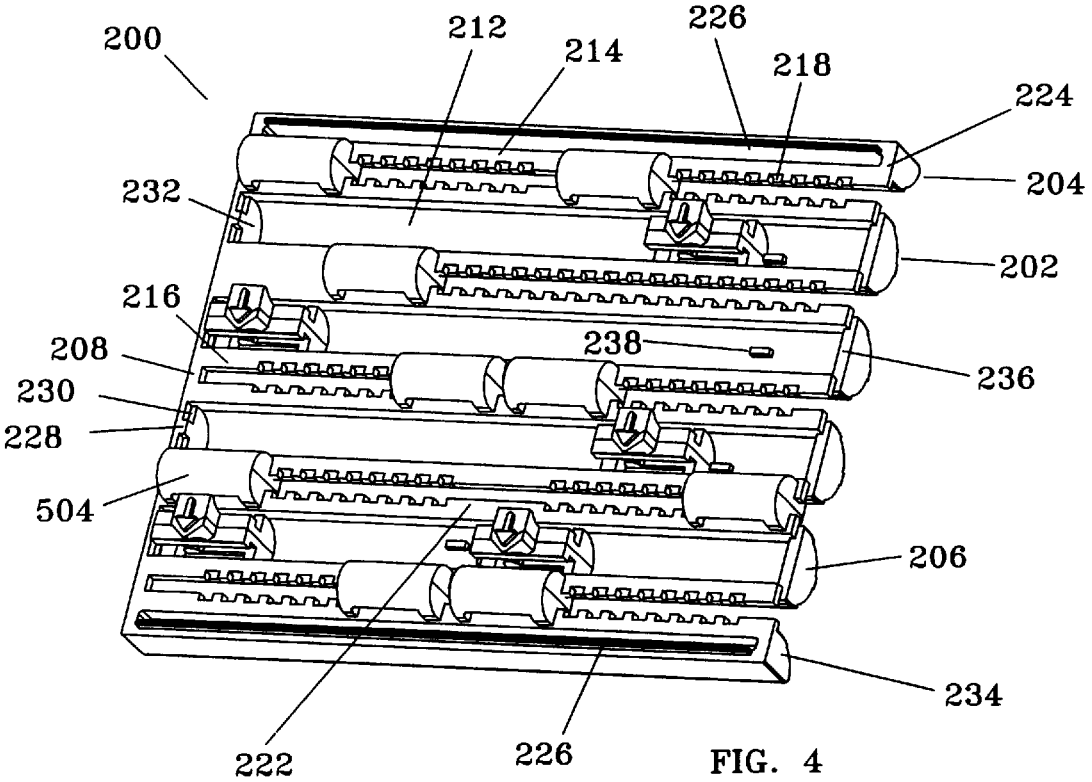
FIG. 4

FIG. 5
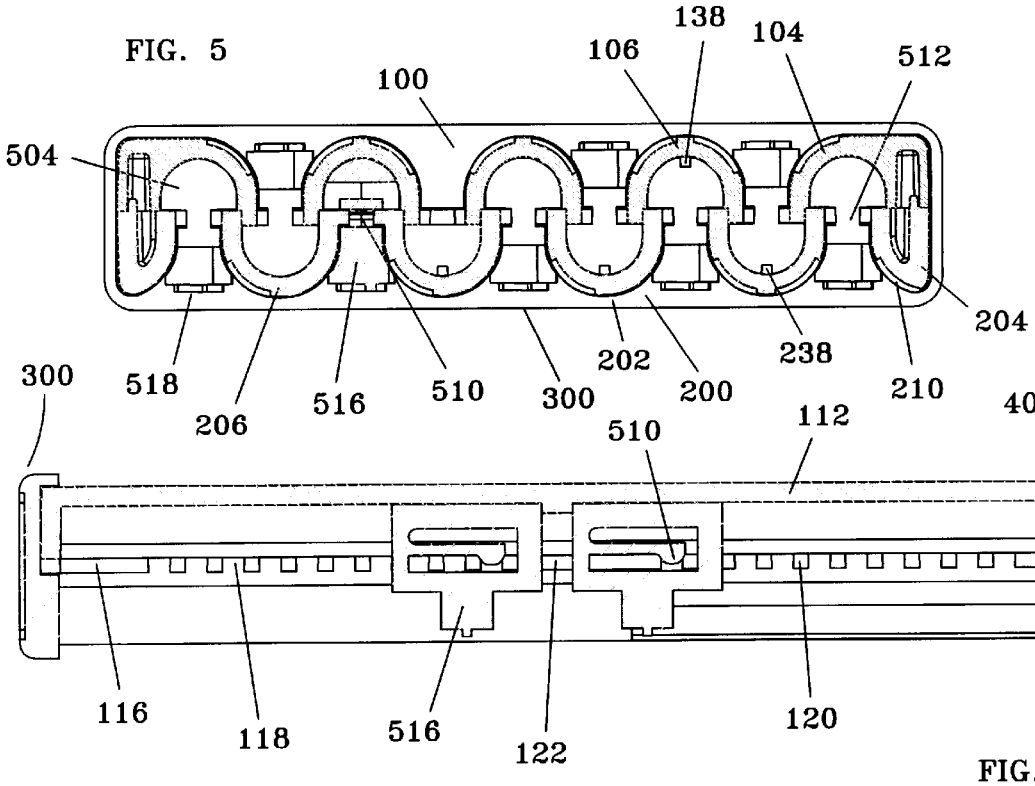
FIG. 6
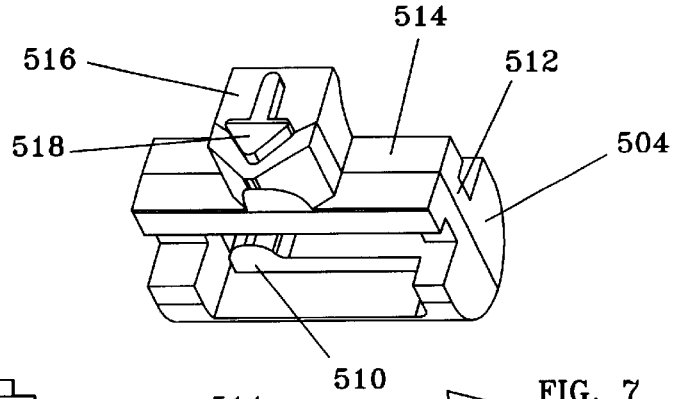
FIG. 7
FIG. 8
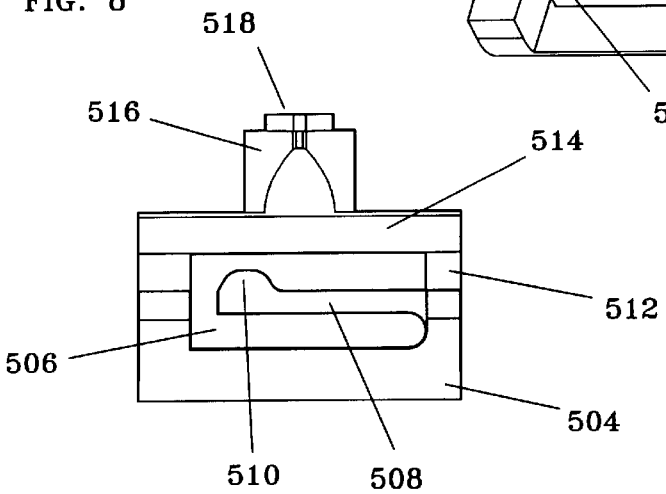
500

GOLF SCORE KEEPING DEVICE

CROSS-REFERENCES

There are no applications related to this application filed in this or any foreign country.

BACKGROUND

Score keeping devices for such games as golf and baseball have been known for some time. Many involve some type of indicator that is incrementally moved in response to the changing score or other statistic. U.S. Pat. No. 3,584,597 shows an example of a device with 18 sliders which correspond to the 18 holes in the game of golf. A plurality of sliders, each having numerals marked on a surface, indicate the score of a single hole. Similarly, U.S. Pat. No. 4,212,261 provides a number of sliders which move in tracks whereby they may point to the appropriate score. A similar idea was disclosed in U.S. Pat. No. 1,468,143, wherein a plurality of indicators were moved against a spring bias to indicate the score for each hole.

Such score keeping devices provide some advantages over the conventional use of score card and pen; however, problems with their design have contributed to a lack of wide-spread adoption of such devices.

The lack of wide-spread adoption of a golf score keeping device has resulted in player's attempting to keep track of statistics in other manners, typically with paper and pencil. Keeping track of statistics is particularly important for a complete analysis of a player's game, since only by statistical analysis can a player determine the areas of the game on which practice would most effectively result in an improved score. For example, where a player has a low ratio of chip and pitch successes per chip and pitch attempts, this fact will be revealed by a sufficiently in-depth statistical analysis of the game. Once the problem has been identified, the player may then begin to address the problem with additional time, concentration and practice.

A principle design problem that has not been adequately resolved by previous score keeping devices is that the sliders typically used to indicate the score tend to be difficult to move when desired, tend to move when not desired, do not always distinctly point to an exact score, and fail to make an affirmative "click" and corresponding "feel" after each movement. Such a "click" and "feel" are required to allow one-handed operation, possibly without even looking at the device.

What is needed is an improved golf score keeping device which resolves the above design issues, and which is therefore suited for wide-spread adoption for routine use by golfers. Such a golf score keeping device would allow players to acquire the in-depth data necessary for adequate statistical analysis of their game. It is only through the use of such data that a concerted effort is possible which will efficiently diagnose areas where problems are present, and areas where additional work is less needed. Such raw data and related statistical information could therefore be used by players of all ability levels to determine the areas where additional concentration, time and practice are most warranted, and possibly other areas on which additional work is less likely to result in a corresponding score improvement.

SUMMARY

The present invention is directed to an apparatus that satisfies the above needs. A novel golf score keeping device is disclosed that provides an improved design, including some or all of the following structures.

(A) A body is formed from interlocking front and back portions. The front portion typically provides an array of five slides, three inside slides and two outside slides, the slides connected to form an array by four bridge elements. Each slide provides a rounded slide trough for support of at least one slide indicator. Each slide defines at least one ribbed slide track; the space between adjacent ribbed slide tracks defined on adjacent slides thereby defining slide channels, within which the slide indicators move.

(B) The back portion typically provides an array of six slides, including four inside slides and two outside slides, connected by five bridge elements. In a manner similar to the front portion, the inside slides provide a rounded slide trough and a pair of ribbed slide tracks, while the outside slides provide a single ribbed slide track. Each rounded slide trough is adjacent to a corresponding slide channel defined by the front portion. Adjacent ribbed slide tracks define a slide channel between them, and each slide channel is adjacent to a corresponding slide trough defined by the front portion.

(C) Left and right end covers fit onto the ends of the body, preventing separation of the front and back body portions.

(D) At least one slide indicator is carried within each slide channel. A preferred version of each slide indicator provides:

(a) A rounded base, sized to slide within the slide trough defined in either the front or back portion.

(b) First and second leg portions, carried by first and second ends of the rounded base.

(c) A shoulder portion, extending between the first and second leg portions, thereby defining a passage through the slide indicator, the passage bounded by the shoulder portion, the first and second leg portions and the rounded base.

(d) A head portion, carried by the shoulder portion and extending through the slide channel associated with the slide trough. A preferred head portion having an indicator or arrow defined on an outer surface.

(e) A resiliently deformable arm, extending from the first leg portion into the passage, the arm carrying a tip which is sized to fit within the gap between the teeth of the slide channel.

It is therefore a primary advantage of the present invention to provide a novel golf score keeping device which provides slide indicators which move in discrete increments, snapping from a first location to a second location with an audible click.

Another advantage of the present invention is to provide a novel golf score keeping device which provides a compact design wherein slide troughs defined in each of the front and back body portions are oppositely oriented and offset or staggered by one-half the distance between similarly oriented adjacent slide troughs on either body portion, thereby producing a device that is compact, functional and which protects the slide indicators from unintentional movement.

Another advantage of the present invention is to provide a novel golf score keeping device which provides a structure having a sufficient number of compactly arrayed slide indicators to support an in-depth data-gathering effort, whereby a player may gain sufficient knowledge of the player's strong and weak areas of play to efficiently plan a strategy for improvement.

A still further advantage of the present invention is to provide a novel golf score keeping device which supports a plurality of slide indicators in a recessed region and in a manner that prevents contact between a flat supporting surface and the slide indicators, thereby reducing the chance of accidental movement.

DRAWINGS

These and other features, aspects, and advantages of the present invention will become better understood with regard to the following description, appended claims, and accompanying drawings where:

FIG. 3 is a perspective view similar to that of FIG. 2, having the back portion removed, thereby showing the inside surface of the front portion.

FIG. 4 is a perspective view similar to that of FIG. 1, having the front portion removed, thereby showing the inside surface of the back portion.

FIG. 5 is a cross-sectional end view of the version of the invention of FIG. 1.

FIG. 6 is a cross-sectional lengthwise view of the version of the invention of FIG. 1.

FIG. 7 is a perspective view of a preferred version of the slide indicator.

FIG. 8 is a orthographic view of the slide indicator of FIG. 7.

DESCRIPTION

Figure 1:
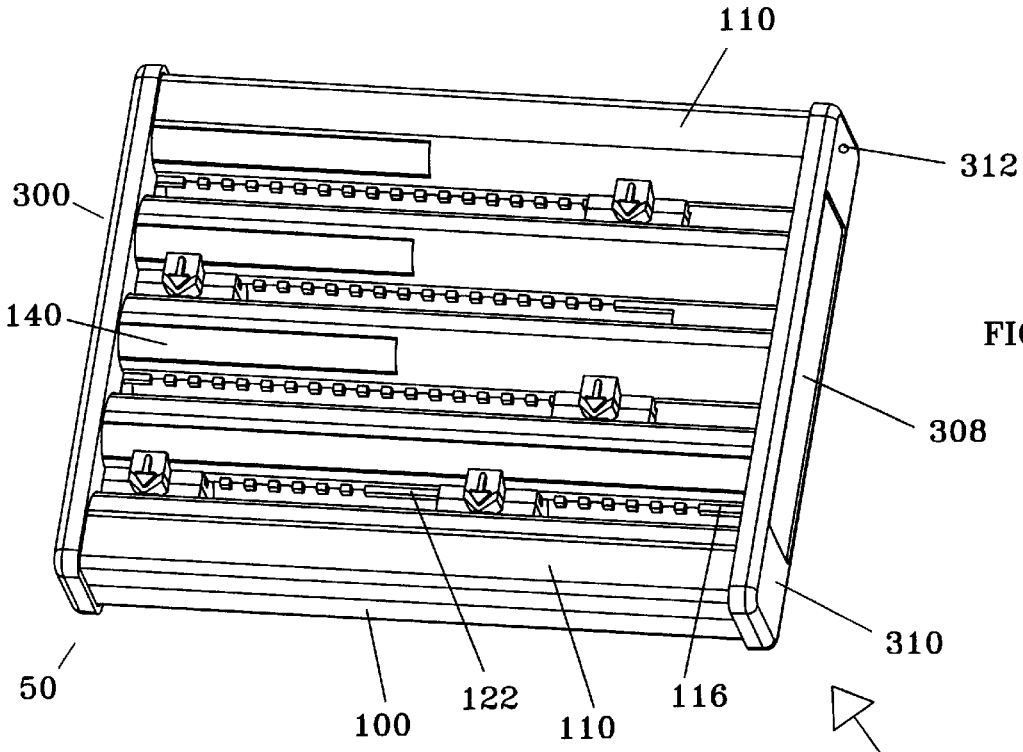
FIG. 1 is a perspective view of the front portion and end covers of a preferred version of the golf score keeping device of the invention.

Referring in generally to FIGS. 1 through 8, a golf score keeping device 10 constructed in accordance with the principles of the invention is seen. A body 50 is formed from interlocking front and back portions 100, 200. A preferred version of the front portion includes five slides, each slide defining a slide trough within which at least one slide indicator 500 may travel. A similar back portion includes six slides having a total of four slide troughs. A slide channel between the slides of each body portion provides spaced teeth which are engaged by an arm extending from the slide indicator, thereby providing a distinct click as the slide indicator is moved a discrete distance. Slide indicators traveling in the slide trough of one portion 100, 200, extend through the slide channel of the other portion 200, 100. Left and right end covers 300, 400 secure the front and back portions, and protect the slide indicators from contact with a flat supporting surface.

As seen particularly in FIGS. 1 through 4, the body 50 of a preferred version of the score keeping device includes a front portion 100 mated to a back portion 200. Referring particularly to FIGS. 1 and 3, it can be seen that a preferred version of the front portion includes five slides 102, including two outside slides 104 and three inside slides 106. The slides are arrayed in a lengthwise parallel manner, as seen, and held together by narrow bridges 108. As seen in FIG. 1, the outside slides provide a flat planar surface 110 which may be used to support some type of logo, slogan or other wording.

An edge 124 defines a recess 126 which is sized to engage an insert 226 extending from a surface 224 of the back portion 200. Friction between the insert and recess holds the front and back portions of the body together.

Each slide defines a slide trough 112, typically having a gently rounded construction, which allows the rounded base of the slide indicator to travel freely. A stop 138 prevents travel by the slide indicator past a certain point. Such control prevents a slide indicator from pointing to numbering or indicia which is associated with another slide indicator.

A ribbed slide track 114 is defined on opposed edges of the inside slides 106, and on the inside edges only of the outside slides 104. A pair of adjacent slide tracks define a slide channel 502 between them, within which the head portion 516 of a slide indicator 500 will travel. Each slide track 114 provides areas of alternating teeth 120 and gaps 118, against which the tip 510 of the slide indicator moves. An end portion of the slide track defines rails 116, the ends of which are sized to fit the end tip gaps 230 of the back portion. In some areas, the slide track provides an elongated tip or skid 122 which separates adjacent slide indicators.

A half circle end 128 supports a single end tip 130 separating twin end tooth gaps 132. The end tooth 130 is sized to fit into the gap between adjacent rails 216 in the back portion. The rails 216 in turn are sized to fit into the end tooth gaps 132.

A further half circle end 134 is adjacent to an end slot 136 defined between opposed rails 116. The end slot is sized to fit over adjacent rails 216 and interconnecting bridge 208 of the back portion.

As seen particularly in FIG. 1, a preferred embodiment of the invention include a supporting area 140 for indicia such as text and sequential Arabic numerals which are associated with the score and statistic-keeping function of the golf score keeping device 10. The supporting area 140 is typically slightly recessed, so that a decal or similar adhesive-backed flexible sheet having numbering or other marking can be supported flush with the adjacent surface.

The indicia, which typically includes numbering, may alternatively be formed into the plastic mold, and may therefore include either raised or recessed numbering or other indicia. Where raised or recessed characters are used, the characters may be accentuated by ink or paint, as desired, and may optionally be made in any color-keyed manner desired.

While the statistics associated with each slide indicator on the front portion are variable, a preferred version of the invention includes a first slide indicator associated with the number of the hole; a second slide indicator associated with the number of drives in the fairway; a third slide indicator associated with the number of greens in regulation; a fourth slide indicator associated with the number of sand saves attempted; and a fifth slide indicator is associated with the number of successful sand saves. As will be seen, analysis of these data elements, and additional data recorded by slide indicators operated from the back portion will allow complete statistical analysis of the golfer's game.

Figure 2:
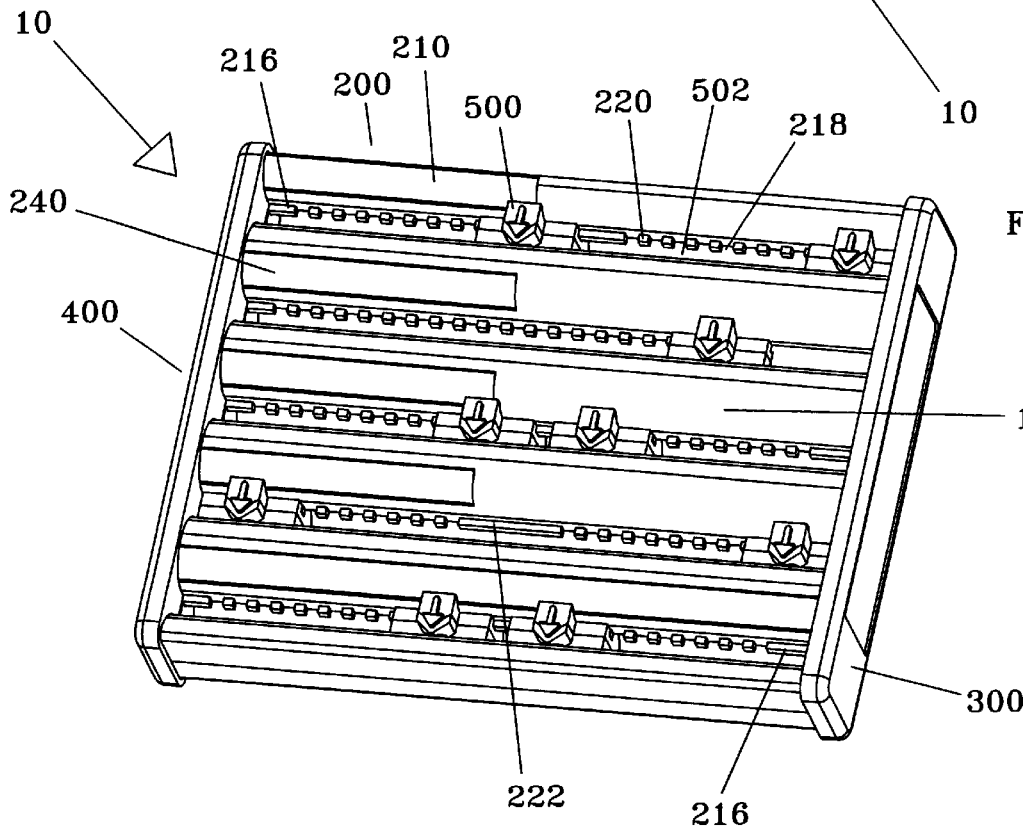
FIG. 2 is a perspective view of the back portion of the score keeping device of FIG. 1.
Figure 9:
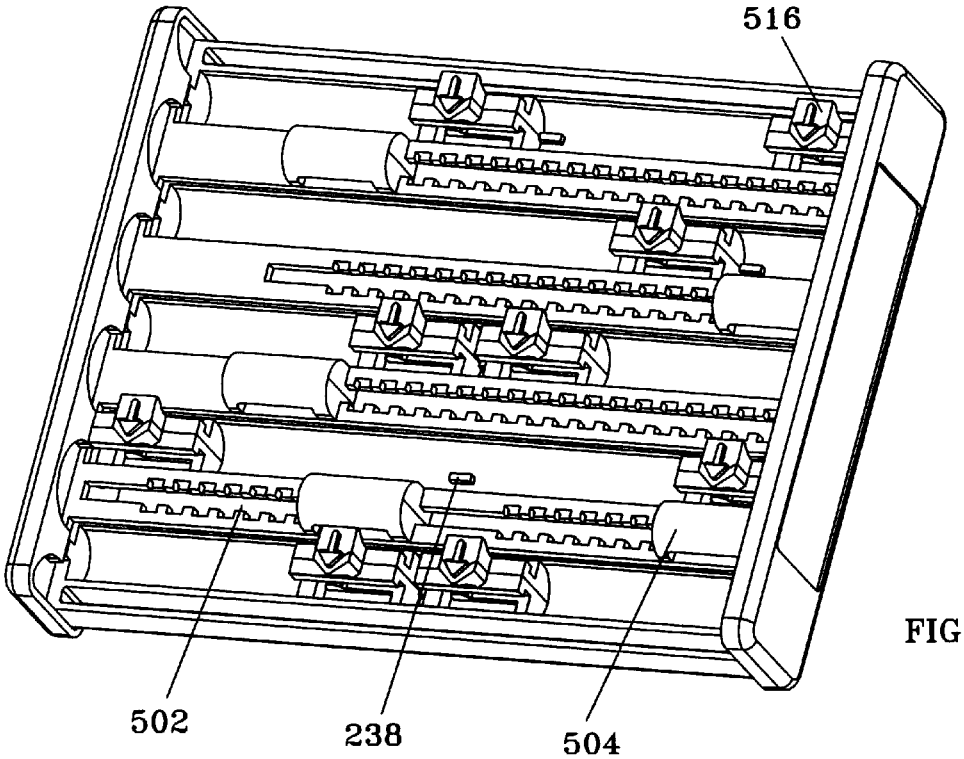
FIG. 9 is a view similar to that of FIG. 3, but with the end covers in place.
Figure 10:
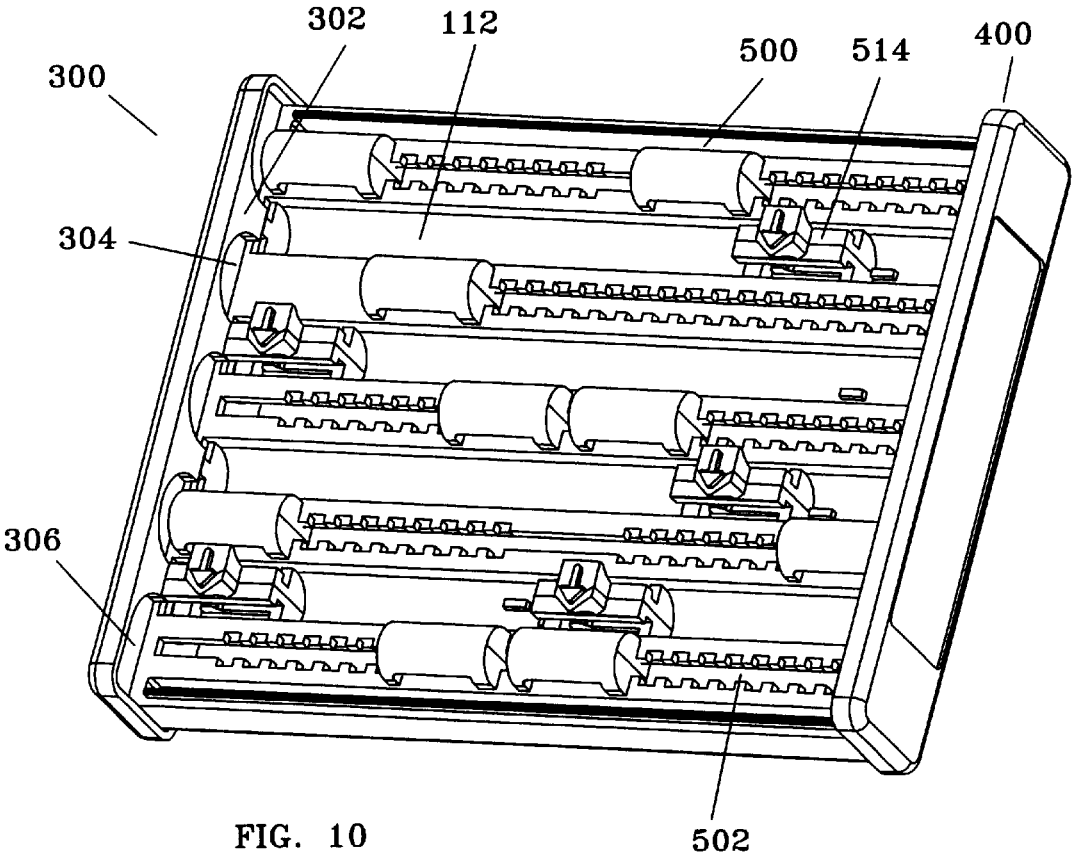
FIG. 10 is a view similar to that of FIG. 4, but with the end covers in place.

Referring particularly to FIGS. 2 and 4, both sides of the back portion 200 of the body 50 are seen. The back portion 200 is similar to the front portion 100, but provides several differences. For the most part, the differences are related to the need to stagger the slide troughs 112, 212, so that the head portion of a slide indicator 500 sliding in one slide trough may poke out through the slide channel 502 between two oppositely directed slide troughs.

Referring particularly to FIGS. 2 and 4, a preferred version of the back portion includes six slides 202, including two outside slides 204 and four inside slides 206. The slides are arrayed in a lengthwise parallel manner, as seen, and held together by narrow bridges 208. As seen in FIG. 2, the outside slides provide a quarter-round surface 210 which may be used to support verbal or numerical indicia.

Each slide defines a slide trough 212, typically having a gently rounded construction, which allows the rounded base of the slide indicator to travel freely. A stop 238 prevents travel by the slide indicator past a certain point. Such control prevents a slide indicator from pointing to numbering or indicia which is associated with another slide indicator.

An insert 226 extending from an edge 224 is sized to engage the recess 126 defined in the edge 124 of the front portion 100.

A ribbed slide track 214 is defined on opposed edges of the inside slides 206, and on the inside edges only of the outside slides 204. A pair of adjacent slide tracks define a slide channel 502 between them, within which the head portion 516 of a slide indicator 500 will travel. Each slide track 214 provides areas or alternating teeth 220 and gaps 218, against which the tip 510 of the slide indicator moves. An end portion of the slide track defines rails 216, the ends of which are sized to fit the end tooth gaps 132 of the front portion. In some areas, the slide track provides an elongate tooth or skid 222 which separates adjacent slide indicators.

A half circle end 232 supports a single end tooth 228 separating twin end tooth gaps 230. The end tooth 228 is sized to fit into the gap between adjacent rails 116 in the front portion. The rails 116 in turn are sized to fit into the end tooth gaps 230.

A quarter round end 234 is adjacent to an end slot 236 defined between opposed rails 216. The end slot is sized to fit over adjacent rails 116 and interconnecting bridge 108 of the front portion.

As seen particularly in FIG. 5, the slide troughs of the front portion and back portion are offset or staggered. This allows the head portions of slide indicators oriented in a first direction to pass between the rounded base portions of slide indicators oriented in a second direction. It is also a key advantage of the offset or staggered construction that the slide indicators are protected by adjacent slides, which prevent unintended movement of the slide indicators due to contact with foreign objects.

As seen particularly in FIG. 1, an area 240 supports indicia or labeling, which in a preferred embodiment of the invention include text and sequential Arabic numerals which are associated with the score and statistic-keeping function of the golf score keeping device 10.

While the statistics associated with each slide indicator are variable, and the number of slide indicators is also variable, a preferred version of the invention includes a sixth slide indicator associated with chip and pitch attempts; a seventh slide indicator is associated with chip and pitch successes; eighth and ninth slide indicators are associated with the number of putts; tenth and eleventh slide indicators are associated with the number of strokes; and the twelfth and thirteenth slide indicators may be left open, to be associated with some other statistic of particular interest to an individual golfer.

As seen in FIGS. 1–4, similar left and right end covers 300, 400 tend to frictionally fit over the end portions of the assembled body 50, preventing unintended disassembly. The end covers may be secured frictionally, or may be glued in place. Each end cover provides an inside surface 302 having half round indentations 304 and end indentations 306 sized to engage the ends of the assembled body 50, as seen. Optionally, a logo inset 308 may be slightly recessed into the outside surface 310, so that a decal or similar media can be used for commercial purposes, or to carry the owner's name and address. A fastener hole 312 may be defined through either end cover, thereby allowing a key chain or other object to be attached. The hole will easily support the weight of the device 10, so that it may be attached to a golf bag or golf cart.

The structure of each slide indicator is particularly disclosed in FIGS. 7 and 8. Each slide indicator provides a rounded base 504, sized for travel within one of the slide troughs 112, 212 of the front or back portion. Extending from each end of the base are legs 512. The legs are connected by a shoulder 514, upon which a head portion 516 is carried. An indicator 518, typically an arrow or similar character, is carried by an upper surface of the head.

As seen particularly in FIG. 8, an arm 508 carrying a tip 510 extends from a first end of the base 504 part of the way across a passage 506 or opening between the base and shoulder.

As seen in FIG. 6, the tip 510 engages the gaps 118, 218 between adjacent teeth 120, 220, and also the space between the gaps 118, 218. When the slide indicator is moved by applying manual force to the head 516, the arm 508 flexes slightly, causing the rounded tip to drop below the teeth 120, 220. Movement of the slide indicator will then result in the tip 510 snapping into place in an adjacent gap 118, 218 with an audible click. The resilience of the arm 508 allows the tip 510 to move under the teeth 120, 220, and then to snap into the gaps between teeth.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a preferred golf score keeping device 10 having slide indicators traveling in four slide channels 502 on the front side and five slide channels on the back side has been disclosed, it is clear that a similar version of the invention could be designed having a greater or lesser number of slide channels and slide indicators. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A score keeping device comprising:

(A) a body, comprising:

(a) a front portion comprising a plurality of slides, including at least one inside slide and two outside slides, the slides connected to form an array by bridge elements, each said slide defining a slide trough and at least one ribbed slide track having alternating teeth and gaps, wherein adjacent said ribbed slide tracks define a slide channel; and (b) a back portion comprising a plurality of slides, including two outside slides and at least two inside slides, each said slide attached to at least one adjacent said slide by a bridge portion, each inside said slide defining a slide trough and two ribbed slide tracks having alternating teeth and gaps and each said outside slide defining a single ribbed slide track, wherein adjacent said ribbed slide tracks define a slide channel; and (c) wherein each said slide trough of the back portion is adjacent to one of said slide channels of the front portion, and wherein each said slide channel of the back portion is adjacent to one of said slide troughs of the front portion;

(B) at least one slide indicator carried by each said slide trough, each said slide indicator comprising:

(a) a rounded base, sized for travel within the slide trough;

(b) a head portion, carried by the rounded base and extending through the slide channel associated with the slide trough, having an indicator; and (c) a resiliently deformable arm, extending from the base into a passage defined by the base, the arm carrying a tip sized to fit within the gap between the teeth of the slide channel.

2. A score keeping device comprising:

(A) a body, comprising:

(a) a front portion comprising a plurality of slides, including at least one inside slide and two outside slides, the slides connected to form an array by bridge elements, each said slide defining a slide trough and at least one ribbed slide track having alternating teeth and gaps, wherein adjacent said ribbed slide tracks define a slide channel; and (b) a back portion comprising a plurality of slides, including two outside slides and at least two inside slides, each said slide attached to at least one adjacent said slide by a bridge portion, each said inside slide defining a slide trough and two ribbed slide tracks having alternating teeth and gaps and each said outside slide defining a single ribbed slide track, wherein adjacent said ribbed slide tracks define a slide channel; and (c) wherein each said slide trough of the back portion is adjacent to one of said slide channels of the front portion, and wherein each said slide channel of the back portion is adjacent to one of said slide troughs of the front portion;

(B) a left end cover, defining half round and end indentations sized for attachment to a left side of the body;

(C) a right end cover, defining half round and end indentations sized for attachment to a right side of the body; and (D) at least one slide indicator carried by each said slide trough, each said slide indicator comprising:

(a) a rounded base, sized for travel within the slide trough;

(b) a head portion, carried by the rounded base and extending through the slide channel associated with the slide trough, having an indicator; and (c) a resiliently deformable arm, extending from the base into a passage defined by the base, the arm carrying a tip sized to fit within the gap between the teeth of the slide channel.

3. A score keeping device comprising:

(A) a body, comprising:

(a) a front portion comprising an array of five slides, including three inside slides two outside slides, the slides connected to form an array by four bridge elements, each said slide defining a slide trough and at least one ribbed slide track having alternating teeth and gaps, wherein adjacent said ribbed slide tracks define a slide channel; and (b) a back portion comprising an array of six slides, including two outside slides and four inside slides, each said slide attached to at least one adjacent said slide by a bridge portion, each said inside slide defining a slide trough and two ribbed slide tracks having alternating teeth and gaps and each said outside slide defining a single ribbed slide track, wherein adjacent said ribbed slide tracks define a slide channel; and (c) wherein each said slide trough of the back portion is adjacent to one of said slide channels the front portion, and wherein each said slide channel of the back portion is adjacent to one of said slide troughs of the front portion;

(B) a left end cover, defining half round and end indentations sized for attachment to the a of the body;

(C) a right end cover, defining half round and end indentations sized for attachment to the a of the body; and (D) at least one slide indicator carried by each said slide trough, each said slide indicator comprising:

(a) a rounded base, sized for travel within the slide trough;

(b) first and second leg portions, carried by first and second ends of the rounded base;

(c) a shoulder portion, extending between the first and second leg portions, thereby defining a passage through the slide indicator, bounded by the shoulder portion, the first and second leg portions and the rounded base;

(d) a head portion, carried by the shoulder portion and extending through the slide channel associated with the slide trough, having an indicator; and (e) a resiliently deformable arm, extending from the first leg portion into the passage, the arm carrying a tip sized to fit within the gap between the teeth of the slide channel.

* * * * *